United States Patent [19]

Buechel et al.

[11] 4,406,079

[45] Sep. 27, 1983

[54] MAGAZINE FOR CASELESS PROPELLANT CHARGES

[75] Inventors: Franz Buechel, Ruggell; Edwin Kindle, Triesen, both of Liechtenstein

[73] Assignee: Hilti Aktiengesellschaft, Schaan, Liechtenstein

[21] Appl. No.: 269,707

[22] Filed: Jun. 2, 1981

[30] Foreign Application Priority Data

Jun. 4, 1980 [DE] Fed. Rep. of Germany ..... 3021186

[51] Int. Cl.[3] ..... F41C 25/00; F42B 39/08; B25C 1/14

[52] U.S. Cl. ..... 42/49 R; 42/1 R; 89/35 R; 102/281; 227/10

[58] Field of Search ..... 42/49 R, 87, 88, 1 M, 42/1 R; 89/1 B, 35 R; 102/281, 431, 433, 434, 531; 227/10

[56] References Cited

U.S. PATENT DOCUMENTS

| | | | |
|---|---|---|---|
| 4,036,103 | 7/1977 | Gawlick et al. | 102/281 |
| 4,056,062 | 11/1977 | Walser et al. | 102/281 |
| 4,063,672 | 12/1977 | Jochum | 227/10 |
| 4,138,788 | 2/1979 | Jochum | 42/1 R |

FOREIGN PATENT DOCUMENTS 1522479 3/1967 France .

*Primary Examiner*—Charles T. Jordan

*Attorney, Agent, or Firm*—Toren, McGeady and Stanger

[57] ABSTRACT

A magazine for caseless propellant charges, such as used in a fastening element setting device, consists of an elongated strip-like member. Cut-outs are provided in the strip-like member and a caseless charge holder is secured in each cut-out by webs. A caseless charge and the holder are displaced out of a cut-out when a sufficient force is directed against the holder to separate the webs from the strip-like member.

7 Claims, 3 Drawing Figures

MAGAZINE FOR CASELESS PROPELLANT CHARGES

SUMMARY OF THE INVENTION

The present invention is directed to a magazine for caseless propellant charges used in a fastening element setting device and the magazine is in the form of an elongated strip-like member with cut-outs for the propellant charges.

Recently the raw material prices for non-ferrous metals used for cartridge shells have been steadily increasing. Because of such costs, the use of caseless propellant charges has become increasingly popular. When using such charges in a setting device there are two ways in which the charges can be utilized. In one arrangement, the propellant charges can be ignited in the magazine itself. Under certain circumstances, this arrangement leads to the ignition of adjacent propellant charges. In another arrangement the propellant charges have been displaced out of the magazine and into a separate combustion chamber for ignition. In this way, the ignition of the adjacent propellant charges can be avoided. There is a problem, however, in that the propellant charges are exposed to mechanical forces during insertion and ejection. This problem is particularly noticeable when a propellant charge is ejected and then reinserted into the magazine a number of times. In addition, there is the problem of providing a seal for the combustion chamber.

Therefore, it is the primary object of the present invention to provide a holder which protects the propellant charges and also affords a seal for the combustion chamber.

In accordance with the present invention, a holder for a propellant charge is secured in each of the cut-outs in the magazine and the holders are connected to the strip-like member forming the magazine by predetermined breakaway sections.

Due to the structure of the holder it is possible to avoid any mechanical forces acting on the propellant charges when the holder and the charge are displaced out of the magazine. Accordingly, propellant charges can be displaced from the magazine into the combustion chamber and then back again into the magazine as often as required without incurring any mechanical damage to the charge. The holders protect the caseless propellant charges against abrasion and similar damage.

If the propellant charges are recessed within the holders so that there is no contact with the charge surface when a holder and charge are displaced from the magazine, then the charges are completely protected. Furthermore, the manner in which the propellant charges are held in the magazine affords a substantial improvement in their storage and transport. In principle, the holders can have any desired form, however, in practice it has been particularly advantageous to shape the holders as sleeves. When the holder is in the form of a sleeve it completely surrounds a propellant charge. With such an arrangement damage to the caseless propellant charges can be substantially avoided. Occasionally, a propellant charge is not ignited or is only partially ignited. When this happens, the sleeve-shaped holder returns the remainder of the propellant charge back into the magazine. As a result, fouling of the combustion chamber is avoided.

A particular problem is forming a seal for the combustion chamber. To provide an effective seal it is advantageous if the holder has a sealing lip projecting inwardly over the face surface of the charge. When a charge is ignited, the propellant gases generated act against the sealing lip and press it against adjoining surfaces of the combustion chamber. A further sealing effect is achieved by the ability of the holder to widen in the radial direction. Advantageously, the sealing lip is formed integrally with the remainder of the holder.

The interconnection of the holder with the strip-like member forming the magazine can be effected in a variety of ways. It has proven to be advantageous, however, to form the predetermined breakaway sections as separating webs. Using such webs, a holder can be displaced out of the cut-out in the strip-like member by applying a certain force. When the required force is applied, the holder along with the propellant charge secured within it can be displaced out of the magazine.

In principle, there is no limitation on the number of separating webs used. To center the holder within the cut-out in the strip-like member, however, it is advantageous if three separating webs are utilized. Three separating webs are sufficient for a defined position of the holder within the strip-like member. When a holder is displaced and then returned into the magazine, the three separating webs act to center it within the cut-out in the strip-like member.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAIL DESCRIPTION OF THE INVENTION

Figures 1, 2, 3:
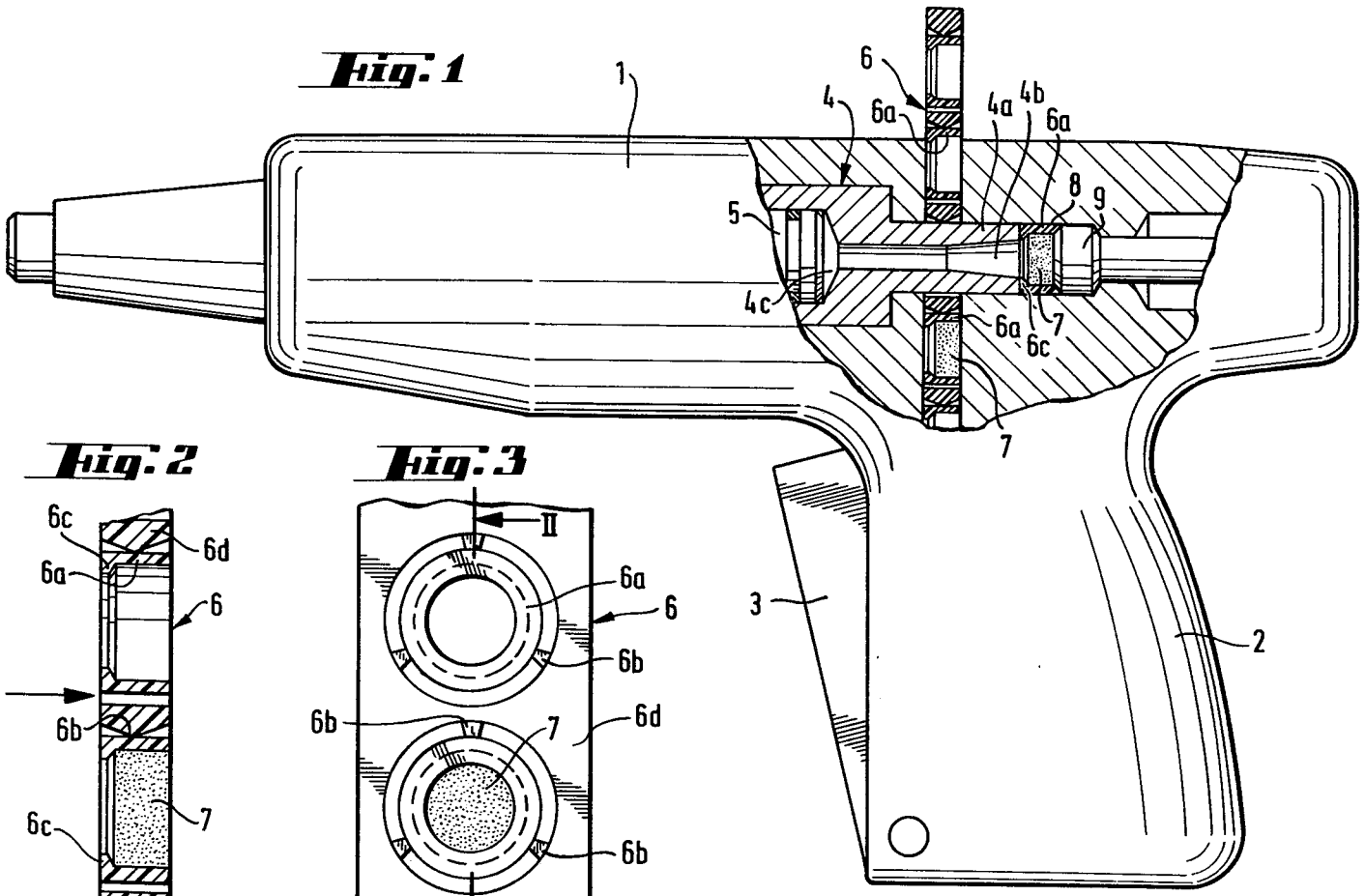
FIG. 1 is a side elevational view, partly in section, of an explosive powder operated fastening element setting device including a magazine incorporating the present invention.
FIG. 2 is an enlarged detail view of the magazine embodying the present invention.
FIG. 3 is a partial elevational view of the magazine illustrated in FIG. 2 taken in the direction of the arrow III.

In FIG. 1 a fastening element setting device is illustrated and includes a housing 1 with a handle 2 extending downwardly from adjacent one end of the housing. The housing 1 and handle 2 have the appearance of a hand gun with a trigger 3 mounted in the handle 2. As viewed in FIG. 1, fastening elements are driven out of the front or muzzle end of the housing 1, that is the left-hand end. The handle 2 depends downwardly from adjacent the rear end of the housing. A barrel 4 is axially displaceably mounted in the housing 1 with the barrel extending outwardly from the front end of the housing. A driving piston 5 is located within the barrel 4 for driving fastening elements into a receiving material. At its rear end within the housing 1, the barrel is shaped to form a feeding member *4a*. In the operation of the setting device, feeding member *4a* is displaced rearwardly through an opening or cut-out in a magazine 6 in the form of an elongated strip-like member. Magazine 6 has a holder *6a* positioned in each of the openings or cut-outs. Each holder 6a is in the form of a sleeve and contains a caseless propellant charge 7. The inside surface of the holder 6a is in gripping contact with the side surface of the charge 7. As viewed in FIGS. 1 and 2 the magazine has a front side facing toward the muzzle end of the housing 1 and a rear side facing toward the rear end of the housing. The front face of the holder 6a is flush with the front side of the magazine, however, the face of the propellant charge directed toward the front end of the housing is recessed rearwardly from the front side of the magazine and the front face of the holder. When the setting device is to be used, the front end of the barrel 4 is pressed against a receiving material and the barrel is moved rearwardly so that the feeding member 4a at its rearward end displaces a holder 6a and its enclosed propellant charge 7 out of the magazine 6 rearwardly into a combustion chamber 8 formed within the housing 1. In the combustion chamber 8, the propellant charge 7 is ignited by a conventional ignition device which is not illustrated. The explosive gases generated during ignition of the charge 7 flow from the combustion chamber 8 through a duct 4b within the feeding member part of the barrel 4 into a working space 4c at the rear end of the bore in the barrel containing the piston 5. The gases acting on the rear end of the piston 5 propel it forwardly so that it drives a fastening element in the front end of the barrel into the receiving material.

Holder 6a includes an integrally formed sealing lip 6c extending radially inwardly over the forwardly facing surface of the charge 7. The sealing lip 6c is at the front face of the sleeve 6a so that it is contacted by the rear end of the feeding member 4a. As can be seen in FIG. 1, the rear end of the feeding member 4a registers with the front face of the holder 6a including the sealing lip 6c. When ignition of a propellant charge 7 takes place, explosive gas is generated within the combustion chamber and presses the sealing lip against the rear end of the feeding member 4a providing an effective seal preventing any explosive gases from by-passing radially outwardly and around the feeding member 4a instead of flowing through the duct 4b. Further, the holder 6a is formed of a material which expands radially outwardly during the ignition process enhancing the sealing effect afforded by the holder. After a propellant charge 7 is ignited, the holder 6a with the feeding member 4a ahead of it is displaced back into the cut-out in the magazine 6 by a push rod 9 mounted in the rear of the housing with the rod forming the rear face of the combustion chamber. During this forward displacement of the holder 6a, any residue of the propellant charge 7 withinn the combustion chamber is carried back into the cut-out in the magazine.

In the enlarged sectional view through the magazine, as shown in FIG. 2, the holders 6a can be seen clearly. Furthermore, the integral sealing lip 6c projecting inwardly over the front face of the propellant charge can also be noted. In addition, a break-away separation web 6b is illustrated and this web connects the holder 6a to the main body or strip-like member 6d forming the magazine 6.

FIG. 3 provides a view of the front side of the magazine 6 shown in FIG. 2. In this figure, the elongated strip-shaped member 6d is also clearly shown. The strip-shaped member 6d has openings spaced apart in its elongated direction with each holder 6a supported in one of the openings. The radially outer surface of the holders are spaced radially inwardly from the surfaces of the openings or cut-outs in the strip-shaped member 6d and the separation webs 6b connect the holders 6a to the main body or strip-shaped member 6d of the magazine 6. When the feeding member 4a of the barrel 4 is displaced rearwardly into contact with a holder 6a the holder is pushed out of the magazine and the break-away separation webs 6b are severed. In FIG. 3, three equiangularly spaced separating webs 6b are shown. Such an arrangement of the separating webs 6b assures centering of the holder 6a prior to use of the magazine and also provides a sufficient grip action for retaining a holder 6a in the cut-out in the magazine after it is returned from the combustion chamber 8 at the end of an ignition cycle.

While specific embodiments of the invention have been shown and described in detail to illustrate the application of the inventive principles, it will be understood that the invention may be embodied otherwise without departing from such principles.

I claim:

1. Magazine for caseless propellant charges comprising an elongated strip-shaped member, said member having cut-outs there-through spaced apart in the elongated direction thereof and each said cut-out arranged to receive a caseless propellant charge, a caseless charge holder located in each of said cut-outs, and means connecting said holder to said strip-shaped member for affording a separation of said holder from said strip-shaped member when a predetermined separating force is applied to said holder.

2. Magazine, as set forth in claim 1, wherein said holder comprises a sleeve arranged to laterally encircle and hold a propellant charge.

3. Magazine, as set forth in claim 2, wherein said strip-shaped member has a first face and an oppositely directed second face, said holder having a first face directed in the same direction as the first face of said strip-shaped member, said sleeve having an inside surface arranged to receive and hold a propellant charge, said sleeve having a radially inwardly directed sealing lip extending inwardly from the inner surface of said sleeve at the first face thereof for spacing the propellant charge held within said holder from the first face thereof and for providing a sealing action when said holder and a propellant charge is displaced into a combustion chamber within a fastening element setting device.

4. Magazine, as set forth in claims 1 or 2, wherein said connecting means comprise separating webs arranged in angularly spaced relationship about the outer surface of said holder and interconnecting said holder and said strip-shaped member.

5. Magazine, as set forth in claim 4, wherein three equiangularly spaced said separating webs interconnect said holder and said strip-shaped member.

6. Magazine, as set forth in claim 3, wherein said sealing lip is formed integrally with said holder.

7. Magazine, as set forth in claim 6, wherein said holder being formed of a radially outwardly expandible material.

* * * * *